United States Patent [19]

Young

[11] Patent Number: 4,736,559

[45] Date of Patent: Apr. 12, 1988

[54] RAISED PANEL PANELING SYSTEM

[76] Inventor: Jerry V. Young, 1200 S. Lee, Morton, Ill. 61550

[21] Appl. No.: 471

[22] Filed: Jan. 5, 1987

[51] Int. Cl.[4] ..... E04B 1/38

[52] U.S. Cl. ..... 52/313; 52/468; 52/506

[58] Field of Search ..... 52/311, 312, 313, 316, 52/506, 455, 456, 287, 468, 471, 716

[56] References Cited

U.S. PATENT DOCUMENTS

| | | | |
|---|---|---|---|
| 741,524 | 10/1903 | Miller | 52/506 |
| 1,430,996 | 10/1922 | Horlin | 52/468 X |
| 2,048,132 | 7/1936 | Madsen | 52/506 X |
| 4,557,096 | 12/1985 | Hovde | 52/313 X |

*Primary Examiner*—Carl D. Friedman

*Attorney, Agent, or Firm*—Polster, Polster and Lucchesi

[57] ABSTRACT

A raised panel paneling system is disclosed comprising a plurality of paneling sheets securable to a substrate, with the edges between adjacent sheets varying between edge-to-edge abutting relation to a substantial maximum permissible gap therebetween so as to permit the sheets of prescribed widths to cover the substrates of varying widths within a limited range. A horizontal rail, such as a chair rail, is applied to the sheets at a predetermined distance so as to divide the sheet into a first portion and a second portion. A stile is applied to the adjacent edges of the sheets so as to cover the joint or the gap between adjacent sheets. A horizontal rail, such as a base board, is applied to one portion of the sheets, and another rail, such as a crown molding rail, is applied to the other end of the panel sheets. Molding is then applied to intersecting rails and stiles, with a mitered joint between the intersecting molding members so as to visually present a finished joint at the intersection of the stiles and the rails without the necessity of providing a coped joint. Alternatively, the panel molding may be applied to the face of one portion of the paneling sheet spaced from the stiles and rails so as to form a raised panel appearance on one of the above-stated panel sheet portions.

10 Claims, 2 Drawing Sheets

RAISED PANEL PANELING SYSTEM

BACKGROUND OF THE INVENTION

This invention relates to a raised panel paneling system, and more particularly to such a paneling system which utilizes flat sheets of paneling board which may be readily secured to a substrate (e.g., drywall) and which may have a variety of styles and shapes of stiles and rails applied thereto so as to give the appearance of full depth raised panel paneling.

Conventionally, raised panel wall or ceiling paneling typically consisted of panel sections made of lumber which was precisely milled to fit together to form the panel sections. These panel sections were so milled and assembled as to visually enhance the fact that they were made of solid lumber. The three-dimensional aspects of the solid lumber paneling sections were accentuated. The panel sections were held together on a wall by a series of vertical stiles and horizontal rails so as to frame around the paneling sections and so as to further enhance the depth perception of the raised panel paneling system. Such conventional prior art paneling systems were expensive because of the amount of wood required to give the appearance of depth or thickness. However, extensive amounts of labor were required for the fabrication of the prior solid wood panel sections, stiles, and rails. Still further, each job was, in essence, a custom job requiring substantial amounts of skilled carpentry labor for proper installation and fit.

In more recent years, substrate wood paneling has become commercially popular. Oftentimes, better grades of such paneling consisted of a substrate of plywood construction typically having a maximum size of about four feet by eight feet, and having a quarter inch thickness. Oftentimes, a high quality hardwood veneer was bonded to one side of the panel substrate. These large sheets of paneling were then secured to furring strips or the like on the walls of a room, and the bottoms of the panel were finished with a horizontal baseboard, and the tops were finished relative to the ceiling by means of a crown molding member. While these sheet paneling systems were considerably less expensive than the prior art solid wood, custom made raised paneling systems, they did not give the impression of three-dimensional depth as was associated with the prior art raised paneling systems.

Also, with sheet paneling systems, it is often necessary to cut the panels in lengthwise or heightwise direction so as to enable the paneling to precisely fit along a wall on which it is to be installed. It will be appreciated that if the substrate panels are uniformly four feet wide, and if the wall of the room on which they are to be installed is, for example, 14 feet, 6 inches in length, it requires substantial cutting and fitting to make the sheet substrate paneling to fit the room precisely without unsightly seams or joints between the panels and without requiring numerous panels of varying widths to panel the wall surface.

Certain prior wall paneling systems have utilized vertical stiles and horizontal rails in combination with the substrate wall paneling sheets so as to enhance the three-dimensional appearance of the wall paneling system. However, in many instances, where the vertical stiles abut against the horizontal rails, it is necessary to cope the upper and lower ends of the vertical stiles so as to provide a coped joint between the stiles and the rails. Because the vertical dimensions of a wall paneling system may vary somewhat in a room due to varying heights of the wall to the floor from one side of a wall to the other, unevenness of ceilings, and other dimensional variations, it is often necessary to make these coped joints between the stiles and the rails in the field. However, it is difficult to form a coped joint in the field both because precise dimensions and expensive wood-shaping equipment are required. It will be appreciated that it is oftentimes difficult and takes highly skilled labor to precisely fit and measure wood paneling in the field as it is being installed. Further, expensive wood-shaping equipment required for coped joints is often quite heavy, cumbersome, and expensive such that it is difficult, if not impossible, to have such equipment readily available at the job site.

Thus, there has been a long-standing need for a paneling system, particularly a wall paneling system, which has many of the low cost advantages of sheet paneling, which avoids the necessity of coped joints, and yet has the aesthetically pleasing three-dimensional qualities of full depth, solid wood raised paneling.

SUMMARY OF THE INVENTION

Among the several objects and features of the present invention may be noted the provision of a paneling system which utilizes sheet paneling and yet which has the appearance of solid wood raised paneling;

The provision of such a paneling system which facilitates the stiles to abut rails with the appearance of a finished joint therebetween without the necessity of coping the joint between the stiles and the rails;

The provision of such a paneling system which permits the installer to readily adapt standard widths of paneling to the particular size room being paneled, without undue cutting and fitting;

The provision of such a paneling system which permits, within a limited range, the paneling to cover the entire wall or other surface using standard size panels without the necessity of cutting or trimming the widths of all of the panels;

The provision of such a paneling system which is available in kits including the sheet paneling, rails, stiles, and molding required for each predetermined width (e.g., each four-foot width) of wall or other room surface to be paneled, and in which additional pieces of rails, stiles, or molding trim required to accommodate non-standard features in the room, such as door frames, window wells, alcoves and the like, are also available as required;

The provision of such a paneling system which, by only requiring lengthwise ripping of the wall panel sheets, and by trimming to length various horizontal rail members, and by mitering to length various panel molding systems, all of which tasks can be readily accomplished by carpenters or other installers at the job site with readily available and conventional tools, so as to facilitate installation and so as to accommodate special features within the room; and The provision of such a panel system which gives the appearance of a solid wood raised paneling system, which is economical, which is pre-finished, and which is relatively easy to install with a minimum of labor or skill required.

Other objects and features of this invention will be in part apparent and in part pointed out hereinafter.

Briefly stated, a raised panel paneling system of the present invention is intended to cover a substrate, such as a wall, from floor to ceiling. However, it will be appreciated that within the broader aspects of this invention, this paneling system can be applied to any number of surfaces or substrates, such as a ceiling, or to large plane surface items within a structure, such as large planter boxes or the like. More specifically, this paneling system comprises a plurality of paneling sheets which are secureable to the wall substrate, with the edges between the adjacent paneling sheets varying between a condition in which the adjacent edges of the adjacent panels abut one another to a condition in which a substantial gap exists between these edges (up to a maximum predetermined gap) so as to permit paneling sheets of prescribed widths to cover walls of varying widths or lengths, within a limited range. A horizontal chair rail or the like is applied to the paneling sheets at a predetermined distance above the floor so as to divide the paneling sheets into a lower wainscoting portion and into an upper paneling portion. A vertical stile is applied to the vertical abutting edges of two of the adjacent sheets above and below the chair rail so as to cover the joint or gap between the adjacent sheets. A horizontal baseboard is applied to the bottom portion of the wainscoting abutting the floor. An upper rail is applied to the upper end of the panel section abutting the ceiling. Further, raised panel means are applied at least to the wainscoting portions or to the upper panel portion of each of the wall paneling sheets for effecting a three-dimensional visual appearance to the panel sheets.

Alternatively, the paneling system of the present invention is substantially as described above, with the exception that the raised paneling means comprises rabbetted panel molding which may be fitted to the vertical edges of the stiles and the horizontal edges of at least some of the rails such that the panel molding intersects one another along a mitered joint at the abutting intersection of the stiles to the rails thereby to provide a finished appearance to the stile-to-rail joint without the necessity of coping this last-mentioned joint.

BRIEF DESCRIPTION OF THE DRAWINGS

Corresponding reference characters indicate corresponding parts throughout the several view of the drawings.

DESCRIPTION OF PREFERRED EMBODIMENTS

Figure 1:
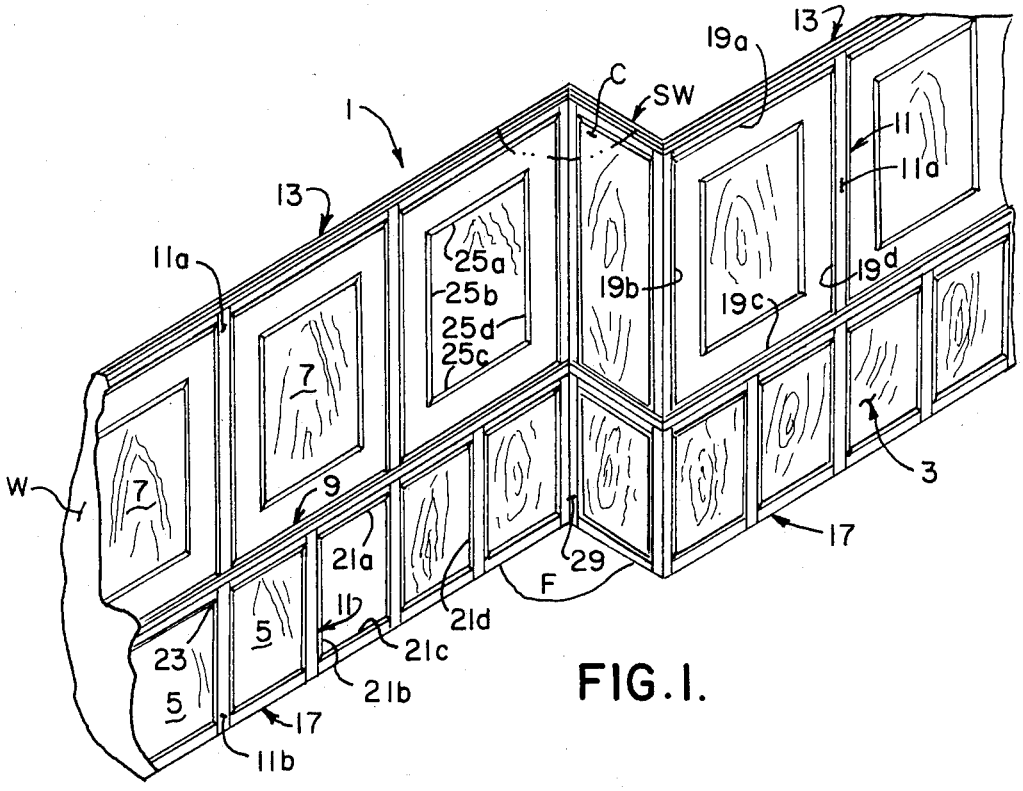
FIG. 1 is a perspective view of a typical wall paneled with the paneling system of the present invention having a plurality of paneling sheets of the present invention and illustrating features, such as alcoves, doorways, and the like, that may also readily be paneled with the paneling system of the present invention.
Figure 2:
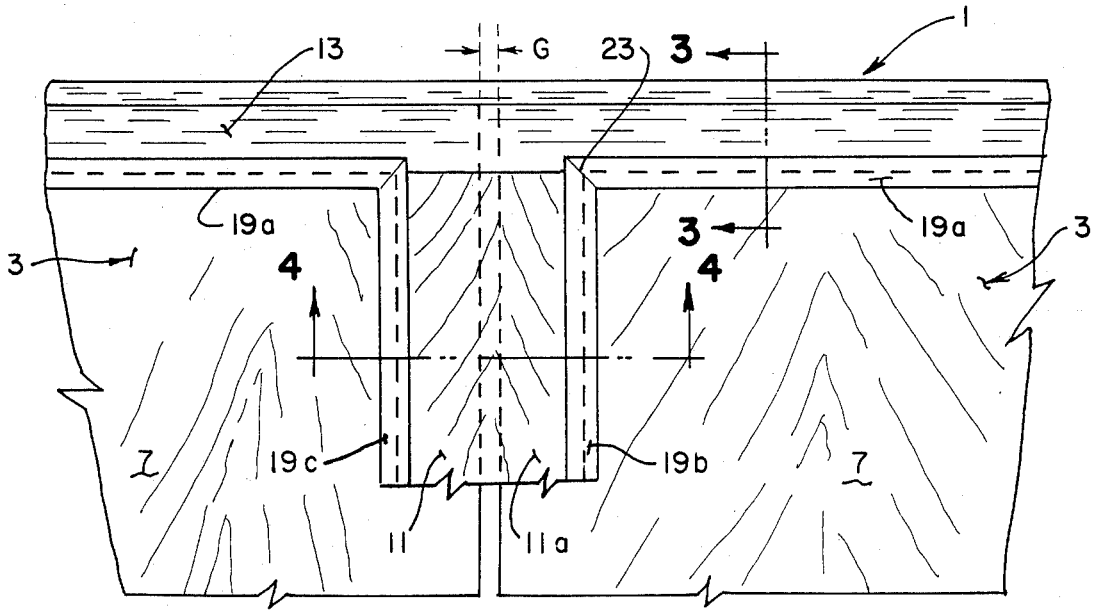
FIG. 2 is a view taken along line 2—2 of FIG. 1 on an enlarged scale, illustrating an abutting joint between a vertical stile and a horizontal rail, utilizing mitered, rabbetted panel molding members applied to the edges of the stile and the rail so as to effect a finished joint appearance between the vertical stile and the rail without the necessity of coping the joint between the stile and the rail.

Referring now to the drawings, a raised panel paneling system of the present invention is shown to be indicated in its entirety by reference character 1. This paneling system is shown to be installed on vertical walls W of a room so as to cover the wall fully from floor F to ceiling C. In the wall paneling system 1 illustrated herein, it will be appreciated that the height from floor F to ceiling C is a standard dimension, such as eight feet (2.46 m.). However, those skilled in the art will recognize that other standardized floor-to-ceiling distances may be utilized. For example, in an office building having floor-to-ceiling distances of nine feet, the paneling, of course, can be nine feet in height as well. Also, within the broader aspects of this invention, the paneling need not cover the entire wall but, as will be hereinafter described, only one portion of the wall (i.e., the lower portion) need be paneled so as to constitute wainscoting or the like. Still further within the broader aspects of this invention, the raised paneling system 1 may be utilized to cover a variety of other surfaces, such as the ceiling of a room so as to give the appearance of a paneled ceiling, and may be utilized to cover or finish other structures, such as large planting boxes, room dividers, sales or service counters, and the like.

Now referring to FIG. 1, the raised panel paneling system 1 of the present invention is shown to comprise a plurality of panel sheets 3 adapted to be secured (i.e., adhesively bonded or nailed) to wall W such that the panel sheets 3 cover substantially all of wall W, and such that the vertical edges of the adjacent panel sheets are parallel.

More particularly, it will be appreciated that panel sheets 3 are of a predetermined width, for example, four feet (1.22 m.). In a manner as will be hereinafter described, wall sheets 3 may readily be field cut by the installer so as to have any desired width such that the panel sheets 3 may be properly sized so as to fit and so as to substantially cover the wall with a minimum amount of cutting and fitting required.

The raised panel paneling system 1 of the present invention is aptly described as a wall sheet, rail, and stile raised panel paneling system. As described above, panel sheets 3 are secured to the wall so as to substantially cover the entire vertical surface of wall W. For example, in the longest wall depicted in FIG. 1, it is assumed that the length of this wall is ten feet, four inches. As noted above, panel sheets 3 come in a standard width of, for example, four feet, such that two full width sheets would only cover eight feet of the wall, while three full sheets would cover twelve feet of the wall. Hence, it is clear that at least some of the panel sheets 3 to be applied to this longest wall in FIG. 1 must be cut to be more narrow. It is preferred that the width of the sheets be balanced so that the wall being paneled has a uniform look. It is generally aesthetically undesirable to have, for example, two full width sheets and one narrow sheet having a width of about two feet. Instead, it is preferred that, for example, the center sheet be maintained at its full four foot width, and that the two outer sheets be cut so as to have a width of about three feet such that the panel sheets, when applied to the wall, will have a balanced appearance. Alternatively, all three sheets can be cut to have a uniform width of about 3 feet, 4 inches.

Once the panel sheets 3 for this elongate wall have been cut to their desired widths, it is preferred that a vertical plumb line be chalk marked on the wall W so as to establish a truly vertical dimension. Then a first sheet is applied to the wall in a true vertical position. The remaining sheets may be further applied to the wall utilizing the first applied sheet as a reference. As will be hereinafter pointed out, it is not essential, in accordance with this invention, that the width of panel sheets 3 be cut precisely such that the panels must be in adjacent edge-to-adjacent edge abutting relation. Instead, a gap G up to a maximum predetermined width is permissible between the adjacent vertical edges of panel sheets 3 applied to a wall. This gives the advantages that the vertical edges of the paneling sheets 3 need not be precisely cut so as to have true vertical edges that will abut in flush abutting relation. It is also an advantage that by permitting a gap G to exist between the adjacent panel sheets and also to exist at the corners of the room, substantial leaway is given to the installer such that the paneling system 1 of the present invention will accommodate rooms of varying length and walls having irregular dimensions. As heretofore noted, the longest wall in FIG. 1 was assumed to have a length of ten feet, four inches. By cutting the three panel sheets to be applied to this longest wall such that two of them have a width of three feet and the third panel is a full width four foot panel, these panels can be installed on the wall so as to have a two-inch gap between their adjacent vertical edges such that the panels fully cover the wall and the necessity of a tight, abutting, vertical joint between the panel sheets is avoided.

Figure 5:
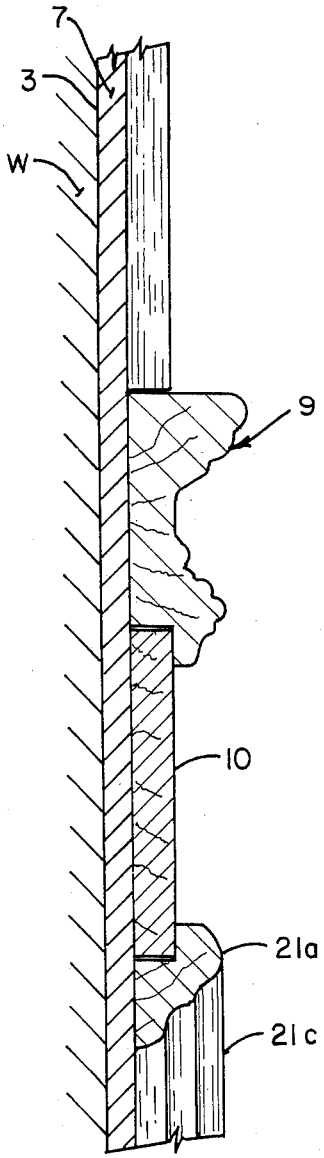
FIG. 5 is a rabbetted cross sectional view, on an enlarged scale, illustrating a chair rail applied to the panel sheets dividing the panel sheets into a lower wainscoting portion and an upper panel portion, with non-rabbetted panel molding applied to the panel sheet below the chair rail so as to at least in part define the above-mentioned wainscoting panel portion.
Figure 6:
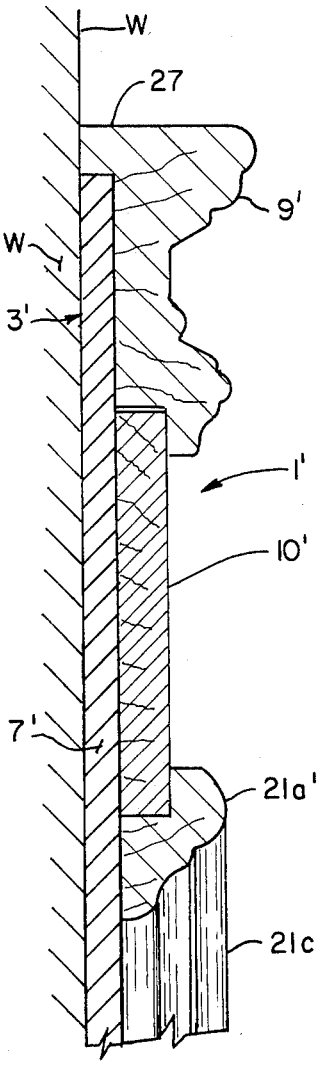
FIG. 6 is a view similar to FIG. 5, illustrating the paneling system of the present invention installed only part of the way up so as to constitute wainscoting paneling having a rabbetted chair rail at the upper edge of the paneling, and having wainscoting panel molding applied to the outer face of the wainscoting panel sheet spaced below the chair rail, above the baseboard, and away from the sides of the adjacent stiles so as to form a raised wainscoting panel substantially within the center of the wainscoting panel sheet.

Further in accordance with this invention, panel sheets 3 are divided into a lower wainscoting panel 5 and an upper wall panel 7 by a horizontal chair rail 9 applied to the outer surface of the panel sheet 3 at a predetermined distance above the floor. As shown in FIGS. 5 and 6, chair rail 9 may be relatively thick so as to enhance its three-dimensional appearance. The chair rail may include a lower chair rail base 10 which abuts the lower margin of the chair rail. Preferably, the chair rail is rabbetted to fit over the upper margin of the base 10. The chair rail may be substantially longer than the width of one of the panel sheets 3, and it may be cut on its ends to abut with another length of the chair rail along the length of a wall being paneled. Of course, in the corners of the room, the chair rail 9 and base 10 may readily be mitered to abut at right angles with the chair rail and base applied to another wall in the corners of the room.

Figure 4:
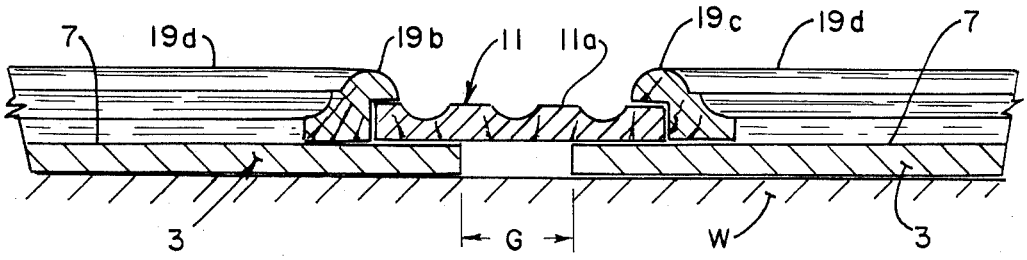
FIG. 4 a cross sectional view, taken along line 4—4 of FIG. 2 illustrating, in cross section, two adjacent paneling sheets applied to the wall with a gap between their adjacent edges, and having a vertical stile applied to the outer faces thereof overlying the gap, and further illustrating the above-mentioned rabbetted panel molding members applied to the edges of the vertical stile and to the upper rail.

Still further in accordance with this invention, vertical stile members, as generally indicated at 11, may be applied to the outer faces of adjacent panel sheets 3 on opposite sides of their adjacent vertical edges so as to overlie the abutting joint between the adjacent vertical edges, or so as to overlie any gap G therebetween, within a limited range. As best shown in FIG. 4, these vertical stile members may have their outer surfaces fluted or otherwise shaped so as to enhance their three-dimensional appearance. Also, the outer vertical edges of the stile members 11 are shown to have square corners. As indicated at 11*a*, an upper panel stile member extends from the upper reaches of chair rail 9 to the ceiling C so as to abut a top rail member 13 applied to the upper portions of the panel sheets, with the top rail 13 also abutting ceiling C of the room. Optionally, crown corner molding (not shown) may be applied between the upper edges of the upper rail 13 and the ceiling. A bottom rail or baseboard member 17 is applied to the lower portions of panel sheets 3 to abut with the floor F and to provide a finished appearance to the bottom portion of the paneling system. A vertical wainscoting stile portion 11*b* (see FIG. 1) extends vertically between the upper edge of baseboard 17 and the lower edge of chair rail base 10.

It will be particularly noted that the paneling system 1 of the present invention, in a manner as will be hereinafter disclosed, permits the ends of the vertical stile members 11*a*, 11*b* to be square or straight cut so as to abut the respective upper and lower edges of chair rail 9 (and base 10) and top rail 13 in the case of upper stile member 11*a*, and so as to abut the lower edge of chair rail base 10 and the upper edge of baseboard 17 in the case of wainscoting stile 11*b*, and yet, surprisingly, to provide a finished joint at these square cut abutting intersections without the necessity of coping the ends of the stile members 11*a*, 11*b*. It will be appreciated that oftentimes, during installation of the paneling system 1 of the present invention, it is necessary that the vertical stile members 11*a*, 11*b* be precisely cut at the job site so as to extend between the baseboard and the chair rail and between the chair rail and the upper rail. These dimensions oftentimes cannot be pre-established with the preciseness required for a finished wall paneling system because of dimensional variations of the walls, and particularly in dimensional variations in the floor-to-ceiling height. Thus, it is essential to a paneling system intended to be installed in the field, that a precise fit at the ends of the vertical stiles and their respective rails be provided without undue labor and without the requirement of special tools or highly skilled carpenters.

Figure 3:
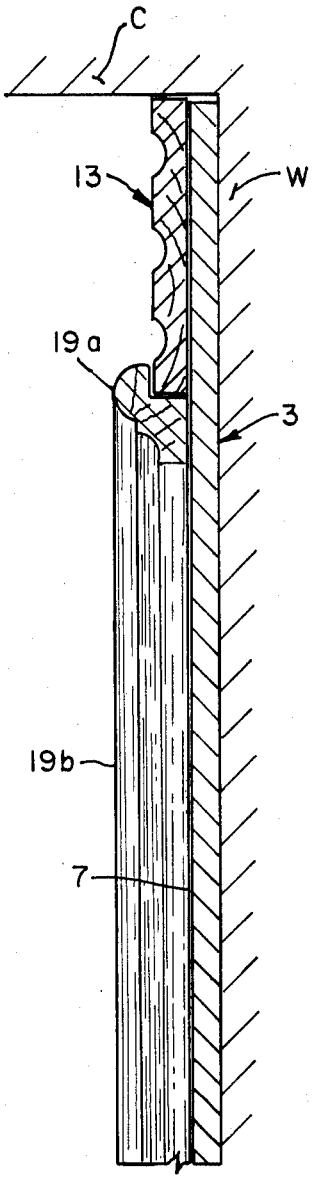
FIG. 3 is a cross sectional view taken along line 3—3 of FIG. 2 illustrating the paneling system of the present invention at the top portion thereof proximate the intersection of the ceiling and the wall of the room, and illustrating a paneling substrate sheet applied to the wall having an upper rail secured to the paneling sheet and abutting the ceiling, and further illustrating rabbetted panel molding applied to the edge of the upper rail and to the vertical stile abutting the upper rail, with the panel molding providing the finished mitered joint appearance illustrated in FIG. 2.

In order to accomplish this objective, the paneling system of the present invention utilizes panel molding members 19*a*–19*d* for the upper panel section, and panel molding members 21*a*–21*d* for the lower wainscoting panels which are rabbetted, as shown in FIGS. 3 and 4, so as, in the case of the upper and lower panel moldings, to overlap, at least in part, the adjacent edges of rails 9 and 13 and stiles 11 so as to enhance the three-dimensional appearance of paneling system 1 and, in a manner as will be hereinafter discussed in detail, to provide a finished appearance between the end-to-side abutting joint between stiles 11 and rails 9 and 13 without the necessity of coping the square ends of the stiles 11.

More specifically, this finished joint appearance at the ends of stiles 11 and rails 9 and 15, is accomplished by providing a mitered joint, as indicated at 23, between the intersecting ends of panel molding members 19*a*–19*d* and 21*a*–21*d*. In this manner, stile members 11*a*, 11*b* can be readily and precisely square cut (i.e., cut perpendicularly) at the job site so as to fit snuggly, as with stile 11*a*, between the bottom edge of upper rail 13 and the upper edge of chair rail 9 and, as with stile 11*b*, so as to fit snuggly between the lower edge of the chair rail and the upper edge of baseboard 17. It will be further noted that the ends of the stile members can be straight cut in a perpendicular fashion, and that these cuts can readily be accomplished in the field by means of a straight cut manual saw or by means of a chop saw or radial arm saw commonly available in the field. Further, upon fitting panel molding members 19*a*–19*d* and 21*a*–21*d* onto their respective rail and stile members in the manner above-discussed, these panel molding members can be precisely cut to an exact length and mitered so as to form tight, precise miter joints 23.

Additional panel molding members, as indicated at 25*a*–25*d*, may optionally be provided on either upper panel section 7 (not shown) or on wainscoting panel section 5 (shown in FIG. 1) spaced inwardly of their respective panel sections from wainscoting members 19*a*–19*d* or 21*a*–21*d* so as to further visually emphasize a three-dimensional raised panel paneling system. More specifically, this inner panel molding is non-rabbetted and is shown in FIG. 6. The non-rabbetted panel molding members 25*a*–25*d* are preferably applied to the outer face of their respective wainscoting panel areas 5 and upper panel areas 7 after chair rails 9, vertical stiles 11*a*, 11*b*, upper rails 13 and baseboards 17 have been installed as described above, together with rabbetted panel molding members 19*a*–19*d* and 21*a*–21*d* secured thereto such that the inner non-rabbetted panel moldings are then centered within their respective wainscoting and upper panel sections, and are secured, as by nailing and/or gluing, to the outer face of panel sheets 3.

It will be appreciated that the raised paneling system 1 heretofore disclosed covers the full height of wall W from floor F to ceiling C. However, those skilled in the art will recognize that a rail and stile raised panel paneling system of the present invention can be readily utilized only as a wainscoting paneling system, in the manner as generally illustrated in FIG. 6. More specifically, in a wainscoting paneling system, as indicated in its entirety by reference character 1', panel sheet 3' is secured to the wall in such manner as to only extend above the floor to a predetermined height (e.g., about 34 inches above the level of floor F). The wainscoting panel sheets 3' are applied along the length of the wall in abutting relation or with gaps G therebetween in the manner as described above in regard to the full wall paneling system 1, with the gaps accommodating, within a limited range, the length of the wall. A rabbetted chair rail 9' is applied to the upper edge of the wainscoting panel. It will be noted that chair rail 9' has an upper extension 27 which extends inwardly toward wall W and provides a finished surface along the upper edge of wainscoting panel sheets 3'. Panel molding members 21*a'*–21*d'* are applied to the bottom of the chair rail, along the inner vertical sides of wainscoting stile members 11*b* and along the top edge of baseboard 17 so as to provide a raised panel appearance around the baseboard, bottom of the chair rails, and stiles. Of course, the portion of wall W above the level of the chair rail 9' may be painted, wall papered, or finished in any desired manner.

It will also be understood that upper stiles 11*a* may be applied directly to wall W in the area directly above the chair rail so as to abut the chair rail at the bottom end and so as to abut upper rail 13 adjacent ceiling C without upper paneling sections 7 being provided on the section of the wall above the chair rail. In this manner, wall paper material or the like may serve as the wall covering between stiles 11*a*.

In accordance with this invention, it is intended that the paneling system 1 of the present invention be commercially available in a series of kits, with each kit comprising, for example, a full size paneling sheet 3, two upper panel section stile members 11*a*, two lower wainscoting stile members 11*b*, upper rail 13, chair rail 9, baseboard 17, upper panel section rabbetted molded members 19*a*–19*d*, and wainscoting panel section molding members 21*a*–21*d* Additionally, inside and outside corner molding members 29 and 31 may be available separate from the kits, as well as additional length of stile members 11, upper rail members 13, baseboard members 17, and chair rails 9 so as to allow the installer to readily accommodate short lengths of walls, door frames, window frames, and openings, alcoves, and other architectural features that are commonly found in many rooms. In this manner, the installer need merely size the room to determine how many standard kits are required, and also this system allows the installer to readily determine what additional pieces of the kit are required to accommodate these special architectural features.

It will be further appreciated that for short wall sections, as shown in the righthand portion of FIG. 1, and as illustrated generally at SW, panel sheets 3 may be cut to fit this short wall section, and the remaining members of the kit may also be appropriately cut to fit this shorter wall section. Again, within the broader aspects of this invention, such cuts can be readily carried out in the field using conventionally available tools, such as radial arm saws and chop saws.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A raised panel paneling system for application to a substrate comprising a plurality of paneling sheets securable to the substrate with the adjacent edges of the paneling sheets being substantially parallel to one another and forming a joint therebetween, at least one rail member secured to one end of said sheet, and a stile member overlying said joint and extending lengthwise thereof and being secured to the margins of two adjacent panels defining said joint, said stile member and said rail member being in abutting relation, at each said abutting intersection between one of said stile members and one of said rail members, one of these members having one of its ends cut square so that said square cut member perpendicularly abuts the other of said members, and a pair of intersecting molding members having their intersecting ends mitered such that when the molding members are applied to said abutting stile member and rail member, the mitered molding members result in the appearance of a finished joint at the intersection of the abutting stile and rail members, said rail and stile members having respective outer edges, and wherein said panel molding members are rabbetted such that a portion of said molding members bears flush against the surface of said panel sheet and bears flush against the outer surface of its respective stile or rail so as to overlie said outer edges of said respective stile and rail members.

2. A paneling system as set forth in claim 1 wherein said panel sheet is a wall paneling sheet extending substantially from top to bottom of a wall, said paneling system further comprising a chair rail applied to said paneling sheet intermediate the top and bottom thereof so as to define an upper panel section above the chair rail and a wainscoting panel section below the chair rail, said stile members being applied to the outer faces of adjacent said sheets along the length of said joint above and below said chair rail.

3. A paneling system as set forth in claim 2 wherein said rail and stile members have respective outer edges, and wherein said panel molding members are rabbetted such that a portion of said molding members bears flush against the surface of said panel sheet and bears flush against the outer surface of its respective stile or rail so as to overlie said outer edges of said respective stile and rail members.

4. A paneling system as set forth in claim 3 further comprising non-rabbetted mold members intersecting with one another so as to form a raised panel shape on a respective upper or wainscoting panel section inwardly of and separate and apart from the paneling section defined by said rabbetted molding members applied to respective rails and stiles defining said upper panel section and said wainscoting panel section.

5. A panel system as set forth in claim 2 further comprising a lower rail or baseboard applied to the outer face of said wainscoting panel sections adjacent the floor and abutting the floor.

6. A paneling system as set forth in claim 1 wherein said paneling sheet is adapted to be applied to the wall and to constitute wainscoting, the upper edge of the wall being spaced above the floor a distance conventional for wainscoting paneling, further comprising a chair rail applied to the upper horizontal edge of said wainscoting paneling, said chair rail fitting flush against the outer face of said wainscoting paneling and having an upper extension above the level of said wainscoting paneling which engages the wall.

7. A raised wall paneling system for covering a wall, said system comprising a plurality of sheets securable to said wall with the vertical edges between adjacent said sheets varying between edge-to-edge abutting relation to a substantial maximum gap therebetween so as to permit said sheets to be adjusted along the width of the wall so as to substantially cover all of the wall within a limited range utilizing sheets of prescribed widths, at least one horizontal rail member applied to said sheets at a predetermined distance above the floor, a vertical stile applied to the vertical adjacent margins of two of said adjacent sheets thereby to cover said joint or gap therebetween, the end of said stile being cut square and perpendicularly abutting said rail, and a pair of intersecting molding members applied to the side edges of said stile and to said rail at the intersection of the stile and the rail with the molding members being mitered at the intersection thereof so as to result in the appearance of a finished joint at the abutting intersection of the square cut stile abutting the rail.

8. A paneling system as set forth in claim 7 wherein said paneling system covers said wall substantially from floor to ceiling, said paneling system further comprising a chair rail intermediate the floor and the ceiling, and a plurality of said stile members perpendicularly abutting the upper and lower edges of said chair rail.

9. A paneling system as set forth in claim 8 further comprising an upper rail secured to the outer faces of said panel sheets adjacent said ceiling and abutting said ceiling, and a baseboard secured to the outer faces of said panel sheets and abutting said floor.

10. A paneling system as set forth in claim 7 further including raised paneling means comprising panel molding applied to the panel portion between said rail and said stile in spaced relation to said molding members applied to said rail and to said stile thereby to create an inner raised paneling portion.

* * * * *